US011162720B2

(12) United States Patent
Crombie et al.

(10) Patent No.: US 11,162,720 B2
(45) Date of Patent: Nov. 2, 2021

(54) REFRIGERANT RECOVERY AND REPURPOSING

(71) Applicant: TRANE INTERNATIONAL INC., Davidson, NC (US)

(72) Inventors: Dermott Crombie, Dublin (IE); Stephen A. Kujak, Brownsville, MN (US)

(73) Assignee: TRANE INTERNATIONAL INC., Davidson, NC (US)

( * ) Notice: Subject to any disclaimer, the term of this patent is extended or adjusted under 35 U.S.C. 154(b) by 289 days.

(21) Appl. No.: 15/750,732

(22) PCT Filed: Aug. 11, 2016

(86) PCT No.: PCT/US2016/046571
§ 371 (c)(1),
(2) Date: Feb. 6, 2018

(87) PCT Pub. No.: WO2017/027716
PCT Pub. Date: Feb. 16, 2017

(65) Prior Publication Data

US 2019/0003755 A1 Jan. 3, 2019

Related U.S. Application Data

(60) Provisional application No. 62/203,794, filed on Aug. 11, 2015.

(51) Int. Cl.
*F25B 43/00* (2006.01)
*F25B 45/00* (2006.01)

(52) U.S. Cl.
CPC ..... *F25B 43/00* (2013.01); *F25B 45/00* (2013.01); *F25B 2345/002* (2013.01)

(58) Field of Classification Search
CPC ..... F25B 43/00; F25B 45/00; F25B 2345/002
See application file for complete search history.

(56) References Cited

U.S. PATENT DOCUMENTS 5,095,713 A * 3/1992 Laukhuf ..... F25B 45/00 62/149
5,117,641 A * 6/1992 Keltner ..... F24F 13/00 62/292

(Continued)

FOREIGN PATENT DOCUMENTS

CN 101346450 A 1/2009
JP H06-10765 U 2/1994

(Continued)

OTHER PUBLICATIONS

International Search Report and Written Opinion, International Patent Application No. PCT/US2016/046571, dated Oct. 12, 2016 (11 pages).

(Continued)

*Primary Examiner* — Ljiljana V. Ciric
(74) *Attorney, Agent, or Firm* — Hamre, Schumann, Mueller & Larson, P.C.

(57) ABSTRACT

A method of converting a refrigerant includes recovering a refrigerant from a refrigeration unit with an evacuation pump and containing the recovered refrigerant in a container. The method also includes testing the recovered refrigerant and converting the recovered refrigerant. The converted refrigerant is different from the recovered refrigerant. A system for converting a refrigerant includes an evacuation pump, a container, and one or more refrigerant containers. The evacuation pump and container are configured to recover a refrigerant from a refrigeration unit. The one or more containers deliver one or more refrigerant components into the container to convert the recovered refrigerant.

9 Claims, 1 Drawing Sheet

(56) References Cited

U.S. PATENT DOCUMENTS 5,181,388 A * 1/1993 Abraham ..... F25B 45/00 62/292
5,226,300 A * 7/1993 Christensen ..... B60H 1/00585 62/292
5,375,426 A * 12/1994 Burgener ..... F25B 45/00 62/292
6,260,372 B1 * 7/2001 Burke ..... F25B 45/00 62/292
9,194,620 B2 * 11/2015 McMasters ..... F25B 45/00
9,435,575 B2 * 9/2016 Harkins ..... C10M 171/008
9,464,833 B2 * 10/2016 McMasters ..... F25B 45/00
10,330,364 B2 * 6/2019 Harkins ..... C09K 5/045
10,563,894 B2 * 2/2020 Ito ..... F25B 1/00
10,571,171 B2 * 2/2020 Gariety ..... F25B 45/00
10,571,172 B2 * 2/2020 Low ..... B01D 11/0288
10,605,507 B1 * 3/2020 Zugibe ..... F24F 11/62
10,876,753 B2 * 12/2020 Cruz ..... F24F 11/38
10,876,775 B2 * 12/2020 Danielson ..... F16K 15/18
10,883,030 B2 * 1/2021 Minor ..... A62D 1/0071
10,889,427 B2 * 1/2021 Koban ..... F16K 1/04
10,890,362 B2 * 1/2021 Kim ..... F25B 31/00
10,895,410 B2 * 1/2021 Hammer ..... F25B 39/028
10,907,635 B2 * 2/2021 Oh ..... F04C 29/028
10,907,862 B2 * 2/2021 Petersen ..... F25B 40/00
10,907,879 B2 * 2/2021 Lavrich ..... B60H 1/00492
10,914,266 B2 * 2/2021 Rolandson ..... F01K 15/02
10,921,032 B2 * 2/2021 Goel ..... F16L 55/02
10,921,033 B2 * 2/2021 Ma ..... F25B 43/00
10,926,608 B2 * 2/2021 Hosokawa ..... F25B 43/00
10,928,091 B2 * 2/2021 Crawford ..... F25B 49/005
10,928,111 B2 * 2/2021 Appler ..... F25B 45/00
10,948,224 B2 * 3/2021 Novek ..... F25B 43/00
10,955,179 B2 * 3/2021 Kulankara ..... F25B 49/027
2002/0046568 A1 * 4/2002 Thomas ..... C09K 5/045 62/77
2003/0042463 A1 * 3/2003 Arman ..... C09K 5/041 252/67
2004/0123622 A1 * 7/2004 Yuzawa ..... F25B 45/00 62/475
2006/0130510 A1 * 6/2006 Murray ..... B60H 1/00585 62/292
2006/0243944 A1 * 11/2006 Minor ..... C09K 3/30 252/67
2007/0108403 A1 * 5/2007 Sievert ..... C09K 5/045 252/67
2008/0000240 A1 * 1/2008 Bakker ..... F25B 45/00 62/77
2008/0099190 A1 * 5/2008 Singh ..... C07C 19/10 165/104.21
2009/0145143 A1 * 6/2009 McMasters ..... B60H 1/00585 62/149
2009/0158771 A1 * 6/2009 Low ..... C09K 5/045 62/498
2009/0188271 A1 * 7/2009 McMasters ..... B60H 1/00585 62/292
2009/0241560 A1 * 10/2009 Murray ..... B60H 1/00585 62/77
2010/0326094 A1 * 12/2010 Tandou ..... F25B 45/00 62/77
2011/0126558 A1 * 6/2011 Thomas ..... C09K 5/045 62/77
2011/0162410 A1 * 7/2011 Low ..... C08J 9/127 62/532
2011/0253927 A1 * 10/2011 Minor ..... C09K 5/045 252/68
2012/0007016 A1 * 1/2012 Abbas ..... F25B 1/005 252/68
2012/0145199 A1 * 6/2012 Jernigan ..... F25B 45/00 134/22.19
2013/0061613 A1 * 3/2013 Rached ..... F25B 1/053 62/77
2013/0247597 A1 * 9/2013 Kontomaris ..... F24H 4/00 62/77
2013/0298578 A1 * 11/2013 McMasters ..... F25B 49/00 62/77
2013/0298995 A1 * 11/2013 McMasters ..... F25B 45/00 137/1
2013/0340447 A1 * 12/2013 Koldewey ..... F25B 45/00 62/77
2014/0216074 A1 * 8/2014 Minor ..... F25B 45/00 62/77
2015/0197677 A1 * 7/2015 Kontomaris ..... C09K 5/044 62/77
2015/0377533 A1 * 12/2015 Harkins ..... F25B 31/002 62/77
2016/0025395 A1 * 1/2016 Harkins ..... C10M 171/008 62/77
2016/0200955 A1 * 7/2016 Ueda ..... F25B 49/005 62/474
2016/0355716 A1 * 12/2016 Fukushima ..... F25B 31/002
2016/0355717 A1 * 12/2016 Fukushima ..... C10M 171/008
2016/0355719 A1 * 12/2016 Fukushima ..... F25B 31/002
2016/0369146 A1 * 12/2016 Ueno ..... C09K 5/045
2017/0058171 A1 * 3/2017 Fukushima ..... F25B 1/00
2017/0058173 A1 * 3/2017 Fukushima ..... F25B 1/00
2018/0320042 A1 * 11/2018 Tasaka ..... C09K 5/045
2018/0320043 A1 * 11/2018 Tasaka ..... C09K 5/045
2019/0003755 A1 * 1/2019 Crombie ..... F25B 43/00
2019/0203992 A1 * 7/2019 Monteith ..... F25B 43/043
2020/0033036 A1 * 1/2020 Yamada ..... F25B 49/02
2020/0355413 A1 * 11/2020 Monteith ..... F25B 40/02
2020/0408314 A1 * 12/2020 Sugino ..... B60C 29/002
2021/0003290 A1 * 1/2021 Ingram ..... F24F 1/32
2021/0003328 A1 * 1/2021 Iovanel ..... F25B 49/02
2021/0003329 A1 * 1/2021 Ingram ..... F24F 1/0007
2021/0003330 A1 * 1/2021 Makino ..... F16L 37/23
2021/0003332 A1 * 1/2021 Nakagawa ..... F25B 49/02
2021/0010704 A1 * 1/2021 Kawashima ..... F25B 41/45
2021/0010728 A1 * 1/2021 Bachellor ..... F25B 41/40
2021/0010731 A1 * 1/2021 Cruz ..... G01L 19/0023
2021/0018245 A1 * 1/2021 Nishida ..... F25D 11/00
2021/0025393 A1 * 1/2021 Hong ..... F04C 29/026
2021/0025629 A1 * 1/2021 Liu ..... F25B 45/00
2021/0033321 A1 * 2/2021 Liu ..... F25B 43/00
2021/0033323 A1 * 2/2021 Kujak ..... C09K 5/044
2021/0040367 A1 * 2/2021 Minor ..... C10M 171/008
2021/0041152 A1 * 2/2021 Jones ..... F25B 45/00
2021/0055022 A1 * 2/2021 Tanaka ..... F28F 1/02
2021/0088263 A1 * 3/2021 Goel ..... F25B 49/005
2021/0092496 A1 * 3/2021 Pistone ..... F25B 45/00
2021/0122962 A1 * 4/2021 Allgood ..... F25B 45/00

FOREIGN PATENT DOCUMENTS

JP 2002-318038 A 10/2002
JP 2012-021770 A 2/2012
JP 2012-140629 A 7/2012
JP 2012-526182 A 10/2012

OTHER PUBLICATIONS

Extended European Search Report, European Patent Application No. 16835917.2, dated Mar. 22, 2019 (7 pages).
Office Action; Japanese Patent Application No. 2018-507025, dated Jul. 7, 2020, with English translation (14 pages).
Office Action, Chinese Patent Application No. 201680058698.X, dated Aug. 3, 2020, with English translation (15 pages).
Decision of Rejection, Japanese Patent Application No. 2018-507025, dated Dec. 8, 2020, with English translation (13 pages).

* cited by examiner

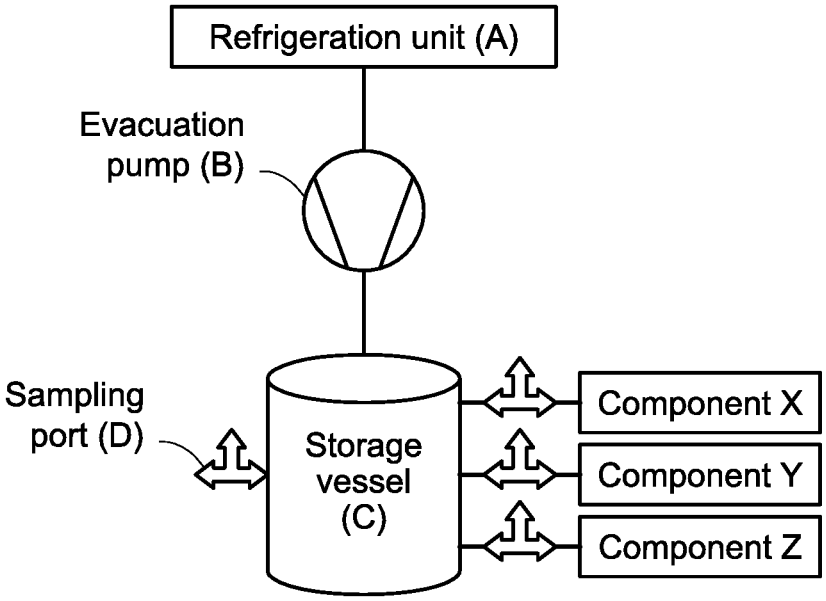
Refrigeration unit (A)
Evacuation pump (B)
Sampling port (D)
Storage vessel (C)
Component X
Component Y
Component Z

REFRIGERANT RECOVERY AND REPURPOSING

FIELD

Embodiments disclosed herein relate generally to recovery and/or repurposing of refrigerant. In particular, methods, systems and apparatuses are disclosed that are directed to on-site recovery and/or repurposing of refrigerant, where an original refrigerant is converted into a refrigerant different from the original refrigerant. The refrigerant converted from the original refrigerant can have relatively lower global warming potential (GWP) than the original refrigerant. The recovery and/or repurposing can be implemented for example in a refrigeration circuit, such as for example in general cooling and/or heating applications, which may be embodied in a heating, venting, and air conditioning (HVAC) system and/or unit, in a transport refrigeration system and/or unit, as well as in commercial, residential and/or industrial cooling and/or heating applications.

BACKGROUND

Refrigerant may be recovered, and then it is shipped to a processing site where it may be destroyed or reused.

SUMMARY

Embodiments disclosed herein relate generally to recovery and/or repurposing of refrigerant. In particular, methods, systems and apparatuses are disclosed that are directed to on-site recovery and repurposing of refrigerant, where an original refrigerant is converted into a refrigerant different from the original refrigerant.

In an embodiment, the refrigerant converted from the original refrigerant can have relatively lower global warming potential (GWP) than the original refrigerant.

In an embodiment, the refrigerant may be converted from an original refrigerant by reclamation in situ, such as for example in an operating refrigerant fluid circuit. In an embodiment, one or more refrigerant components may be added and/or removed from the original refrigerant to arrive at the converted refrigerant.

In an embodiment, the refrigerant may be converted from an original refrigerant through reclamation of the original refrigerant into a container, e.g. cylinder, where one or more refrigerant components are added and/or removed from the original refrigerant to arrive at the converted refrigerant.

In an embodiment, adding one or more refrigerant components includes charging in situ or in the container one or more refrigerants to add to the original refrigerant.

In an embodiment, the container with the converted refrigerant is repurposed to another unit.

In an embodiment, the container with the converted refrigerant is a drop in replacement for another unit. In an embodiment, the container with the converted refrigerant is compatible with other units and includes, if necessary, suitable connections, valves, and seals, e.g. gaskets, for connecting the container to another unit, such as for repurposing, and also for re-connecting the container to the original unit.

In an embodiment, the refrigerant converted from the original refrigerant has a ratio of refrigerant components different from a ratio of refrigerant components in the original refrigerant.

In an embodiment, the amount(s) and/or the type(s) of refrigerant component(s) in the refrigerant converted from the original refrigerant is different from the original refrigerant.

In an embodiment, the converted refrigerant is effectively a dilution of the GWP relative to the original refrigerant.

In an embodiment, a filter and/or dryer is employed when converting the original refrigerant to the converted refrigerant.

In an embodiment, a unit performance test is conducted to verify, confirm operation of the converted refrigeration in the same unit from which the original refrigerant was employed or in another unit into which the converted refrigerant is repurposed.

In an embodiment, the recovery of refrigerant and/or repurposing of a refrigerant converted from an original refrigerant can be implemented for example in a refrigerant fluid circuit, such as a refrigeration circuit.

In an embodiment, the refrigeration circuit can be a general cooling and/or heating applications. In an embodiment, the general cooling and/or heating application is in a heating, venting, and air conditioning (HVAC) system and/or unit.

In an embodiment, the general cooling and/or heating application is in a transport refrigeration system and/or unit.

In an embodiment, the general cooling and/or heating application is in a commercial, a residential and/or an industrial cooling and/or heating application, including systems thereof, and the like.

DRAWINGS

These and other features, aspects, and advantages of the will become better understood when the following detailed description is read with reference to the accompanying drawing, wherein:

The FIGURE is a schematic illustration of an example of refrigerant recovery and repurposing.

DETAILED DESCRIPTION

Embodiments disclosed herein relate generally to recovery and/or repurposing of refrigerant. In particular, methods, systems and apparatuses are disclosed that are directed to on-site recovery and/or repurposing of refrigerant, where an original refrigerant is converted into a refrigerant different from the original refrigerant. The refrigerant converted from the original refrigerant can have relatively lower global warming potential (GWP) than the original refrigerant. The recovery and/or repurposing can be implemented for example in a refrigeration circuit, such as for example in general cooling and/or heating applications, which may be embodied in a heating, venting, and air conditioning (HVAC) system and/or unit, in a transport refrigeration system and/or unit, as well as in commercial, residential and/or industrial cooling and/or heating applications.

In an embodiment, a refrigerant is converted from an original refrigerant, such as a previously used refrigerant from an operating or previously operating refrigerant fluid circuit. In an embodiment, the original refrigerant is tested and analyzed to determine how it may be converted into a refrigerant different from the original refrigerant. It will be appreciated that such testing and/or analysis may be done at a laboratory and/or on-site for example using known methodologies. Converting the original refrigerant can be done by adding and/or removing one or more refrigerant components into and/or from the original refrigerant. The converted refrigerant can be re-used in the same unit or used in another unit, or for a different application.

In an embodiment, the original refrigerant can be composed of one or more refrigerant components (e.g. refrigerant types) and the converted refrigerant resulting from conversion of the original refrigerant can be composed of one or more refrigerant components.

In an embodiment, the refrigerant may be converted from an original refrigerant in situ, such as for example in an operating refrigerant fluid circuit. In an embodiment, one or more refrigerant component s may be added and/or removed from the original refrigerant to arrive at the converted refrigerant. In an embodiment, in situ means on-site, whereas "on-site" means for example the location where the refrigerant is being used, such as the location of a machine for example a refrigeration unit, e.g. cooling and/or heating system, whether it is in operation or not.

As one example, the original refrigerant to converted refrigerant can be reclamation by in situ conversion of R134a refrigerant in a chiller and/or bus to R513A. The result of R513A can be achieved through mixing within the unit.

In an embodiment, the refrigerant may be converted from an original refrigerant through reclamation of the original refrigerant into a container, e.g. cylinder, where one or more refrigerant components are added and/or removed from the original refrigerant to arrive at the converted refrigerant.

As one example, the original refrigerant to converted refrigerant can be the reclamation of all or a portion of the R134a from an existing unit into a container, e.g. cylinder, which contains or would have added to it an amount of R1234yf to make up the resulting R513A.

In an embodiment, the container or unit may be recharged with the correct amount of refrigerant (e.g. R1234yf), leaving out excess R134a, if any, to arrive at the targeted or desired converted refrigerant, which in some cases is a blend.

In an embodiment, the GWP of R134a is about or over 1400, whereas the GWP of R513A is about 630, which is significantly less than the GWP of R134a, and in some instances less than half.

The FIGURE shows an embodiment of refrigerant reclamation into a container, e.g. cylinder, using a reclamation system.

As shown in the FIGURE, refrigerant is recovered from refrigeration unit (A), for example in one embodiment by utilizing an evacuation pump (B). In an embodiment, the refrigerant is stored in a container, such as storage vessel (C).

In an embodiment, the refrigerant is sampled via port (D). Analysis of the recovered (e.g. original) refrigerant allows addition of other refrigerant components to be determined.

In an embodiment, the addition of other refrigerant components may come from a container, X, Y, and/or Z.

In an embodiment, to create a new blend, for example to meet a certain R400 or R500 series of refrigerant, one or more refrigerant components from the container(s) X, Y, and/or Z is added to the container (C).

It will be appreciated that suitable connections, valves, and seals, e.g. gaskets, for connecting the container (C) to the pump (B), the refrigeration unit (A), the containers including components (X), (Y), and/or (Z) are provided in the system shown in the FIGURE. The arrows shown in the FIGURE indicate potential fluid flow directions depending on the application desired.

It will be appreciated that the container (C) includes one or more openings suitable to feed one or more refrigerant components from the container (X), (Y), and/or (Z). It will be appreciated that port (D) may be used as such an opening.

The converted refrigerant can be reused either in the source refrigeration unit, or in another unit or application. For example, R134a can be re-purposed as R513A through the reclamation system.

In an embodiment, any R452 blend can be repurposed into any other system using R452 blend. In an embodiment, an original refrigerant, e.g. R410A, may be converted to an R452 blend.

The charts below are examples of converted refrigerants from original refrigerants in refrigeration systems types, including chillers, bus, and stationary.

Product in situ R134a conversion to R513A in a chiller, e.g. in a water cooled screw chiller: Conversion Chart I.

| Rated Capacity (tons) | Original R134a Refrigerant Charge (lbs) | Reclamation of R134a (lbs) from Unit | Addition of R1234yf (lbs) to Unit |
|---|---|---|---|
| 100 | 200 | 112.00 | 112.00 |
| 125 | 250 | 140.00 | 140.00 |
| 150 | 300 | 168.00 | 168.00 |
| 200 | 400 | 224.00 | 224.00 |
| 250 | 500 | 280.00 | 280.00 |
| 300 | 600 | 336.00 | 336.00 |
| 350 | 700 | 392.00 | 392.00 |
| 400 | 800 | 448.00 | 448.00 |

Product in situ R134a conversion to R513A in a chiller, e.g. in a water cooled screw chiller: Conversion Chart II.

| Rated Capacity (tons) | Original R134a Refrigerant Charge (lbs) | Reclamation of 100% R134a (lbs) from Unit into an evacuated Refrigerant Recovery Cylinder | Addition of R1234yf (lbs) to R134a Refrigerant Recovery Cylinder to make R513A | R513A Recharge Amount (lbs) | Excess R513A (lbs) |
|---|---|---|---|---|---|
| 100 | 200 | 200.00 | 254.55 | 200.00 | 54.55 |
| 125 | 250 | 250.00 | 318.18 | 250.00 | 68.18 |
| 150 | 300 | 300.00 | 381.82 | 300.00 | 81.82 |
| 200 | 400 | 400.00 | 509.09 | 400.00 | 109.09 |
| 250 | 500 | 500.00 | 636.36 | 500.00 | 136.36 |
| 300 | 600 | 600.00 | 763.64 | 600.00 | 163.64 |
| 350 | 700 | 700.00 | 890.91 | 700.00 | 190.91 |
| 400 | 800 | 800.00 | 1018.18 | 800.00 | 218.18 |

Product in situ R134a conversion to R513A in a bus, e.g. bus air conditioner: Conversion Chart III.

| Original R134a Refrigerant Charge (lbs) | Reclamation of R134a (lbs) from Unit | Addition of R1234yf (lbs) to Unit |
|---|---|---|
| 11.03 | 6.17 | 6.17 |
| 14.33 | 8.03 | 8.03 |
| 17.86 | 10.00 | 10.00 |
| 17.86 | 10.00 | 10.00 |
| 17.86 | 10.00 | 10.00 |
| 17.86 | 10.00 | 10.00 |
| 6.17 | 3.46 | 3.46 |
| 8.16 | 4.57 | 4.57 |
| 8.16 | 4.57 | 4.57 |
| 8.16 | 4.57 | 4.57 |
| 8.38 | 4.69 | 4.69 |
| 4.85 | 2.72 | 2.72 |

Reclamation (container) Method for R134a to R513A in a bus, e.g. bus air conditioner: Conversion Chart IV.

| Original R134a Refrigerant Charge (lbs) | Reclamation of 100% R134a (lbs) from Unit into an evacuated Refrigerant Recovery Cylinder | Addition of R1234yf (lbs) to R134a Refrigerant Recovery Cylinder to make R513A | R513A Recharge Amount (lbs) | Excess R513A (lbs) |
|---|---|---|---|---|
| 11.03 | 11.03 | 14.03 | 11.03 | 3.01 |
| 14.33 | 14.33 | 18.24 | 14.33 | 3.91 |
| 17.86 | 17.86 | 22.74 | 17.86 | 4.87 |
| 17.86 | 17.86 | 22.74 | 17.86 | 4.87 |
| 17.86 | 17.86 | 22.73 | 17.86 | 4.87 |
| 17.86 | 17.86 | 22.73 | 17.86 | 4.87 |
| 6.17 | 6.17 | 7.86 | 6.17 | 1.68 |
| 8.16 | 8.16 | 10.39 | 8.16 | 2.23 |
| 8.16 | 8.16 | 10.39 | 8.16 | 2.23 |
| 8.16 | 8.16 | 10.39 | 8.16 | 2.23 |
| 8.38 | 8.38 | 10.67 | 8.38 | 2.29 |
| 4.85 | 4.85 | 6.17 | 4.85 | 1.32 |

The FIGURE may be used to achieve the different converted blends shown in any of the Charts I, II, III, and IV.

Reclamation (container) of R410A conversion to R452B in a stationary air conditioner: Conversion Chart V.

| Rated Capacity | Original R410A Refrigerant Charge (lbs) | Reclamation of 100% R410A (lbs) from Unit into an evacuated Refrigerant Recovery Cylinder | R452B Formulation Mixture Cylinder (lbs of refrigerant) | R32 (lbs) in Formulation Cylinder | R1234yf (lbs) in Formulation Cylinder | Total R452B Amount (lbs) | Recharge of Unit with R452B (lbs) | Excess R452B (lbs) |
|---|---|---|---|---|---|---|---|---|
| 15 | 7.55 | 7.55 | 46.22 | 32.22 | 14.00 | 53.77 | 6.80 | 46.98 |
| 15 | 7.55 | 7.55 | 46.22 | 32.22 | 14.00 | 53.77 | 6.80 | 46.98 |
| 15 | 7.55 | 7.55 | 46.22 | 32.22 | 14.00 | 53.77 | 6.80 | 46.98 |
| 17.5 | 8.35 | 8.35 | 51.12 | 35.64 | 15.48 | 59.47 | 7.52 | 51.96 |
| 17.5 | 8.35 | 8.35 | 51.12 | 35.64 | 15.48 | 59.47 | 7.52 | 51.96 |
| 20 | 10.15 | 10.15 | 62.14 | 43.32 | 18.82 | 72.29 | 9.14 | 63.16 |
| 20 | 10.15 | 10.15 | 62.14 | 43.32 | 18.82 | 72.29 | 9.14 | 63.16 |
| 25 | 10.2 | 10.2 | 62.45 | 43.54 | 18.91 | 72.65 | 9.18 | 63.47 |
| 25 | 10.2 | 10.2 | 62.45 | 43.54 | 18.91 | 72.65 | 9.18 | 63.47 |

The FIGURE may be used to achieve the different converted blends in shown in Chart V.

It will be appreciated that the above original refrigerants and converted refrigerants are exemplary refrigerants (e.g. blends) only. Other original or recovered refrigerants may be converted, e.g. other types of R400 series and R500 blends, into suitable converted refrigerants based on certain desired or suitable blends, targeted or necessary blends, depending on the application. In an embodiment, the application can be for example to lower overall GWP and/or to achieve a different property for the resulting converted refrigerant. It will be appreciated that R400 and R500 series refrigerant blends, for example, are composed of two or more refrigerant components. In some cases, a converted, e.g. "next-generation", refrigerant is a blend of a previous generation, plus one or more new refrigerant components. By recovering the original (e.g. previous) refrigerant, and by adding the new appropriate refrigerant component(s) in the correct ratios, a converted blend can be produced.

As above, examples of this include: R134a (GWP about 1410) which has a GWP that is more than two times R513A (GWP=631). R513A can be obtained by the addition of R1234yf to the reclaimed R134a.

Advantages of repurposing refrigerant in accordance with the concepts described herein include: re-use (e.g. recycling) of an existing refrigerant; avoiding returning old refrigerant to a central recycling plant, with associated shipping and time costs; encouraging responsible re-use of refrigerant when possible; and allowing for meeting low-GWP regulations in a quick and simple manner.

Furthermore, repurposing refrigerant in accordance with the concepts described herein include potentially saving time, reducing refrigerant handling, reducing cost, and reducing the potential for greenhouse gas (GHG) emissions to the atmosphere.

By repurposing a relatively high GWP at the use location, the cost and complexity of returning the high GWP refrigerant to a central location is avoided. Additionally, the relatively high GWP refrigerant may be used as a component of a next generation lower GWP refrigerant, which can save cost and reduce potential future greenhouse gas (GHG) emissions.

Generally, the methods, systems, and apparatuses herein are able to produce a converted, lower GWP refrigerant, for re-use, re-purposing, and the like.

The terminology used in this specification is intended to describe particular embodiments and is not intended to be limiting. The terms "a," "an," and "the" include the plural forms as well, unless clearly indicated otherwise. The terms "comprises" and/or "comprising," when used in this specification, indicate the presence of the stated features, integers, steps, operations, elements, and/or components, but do not preclude the presence or addition of one or more other features, integers, steps, operations, elements, and/or components.

With regard to the preceding description, it is to be understood that changes may be made in detail, especially in matters of the construction materials employed and the shape, size, and arrangement of parts, without departing from the scope of the present disclosure. The word "embodiment" as used within this specification may, but does not necessarily, refer to the same embodiment. This specification and the embodiments described are examples only. Other and further embodiments may be devised without departing from the basic scope thereof, with the true scope and spirit of the disclosure being indicated by the claims that follow.

The invention claimed is:

1. A method of converting in situ a refrigerant into a refrigerant blend with a lower global warming potential, comprising:

recovering a refrigerant from a refrigeration unit using an evacuation pump, the recovered refrigerant including one or more refrigerants;

containing the recovered refrigerant in a container;

sampling from the container the recovered refrigerant;

testing the recovered refrigerant; and converting in situ the recovered refrigerant into a converted refrigerant, the converting resulting in the converted refrigerant having a global warming potential that is lower than the global warming potential of the recovered refrigerant, wherein the converting comprises adding one or more additional refrigerants different from any one of the one or more refrigerants in the recovered refrigerant into the container with the recovered refrigerant, the one or more additional refrigerants having a lower GWP than the recovered refrigerant.

2. The method of claim 1, further comprising one or more of using the converted refrigerant in the refrigeration unit, using the converted refrigerant in another refrigeration unit, and storing the converted refrigerant.

3. The method of claim 1, wherein the converting comprises diluting of the recovered refrigerant to obtain the converted refrigerant.

4. The method of claim 1, wherein the converting comprises using one or more of a filter and dryer.

5. The method of claim 1, wherein the converting comprises removing one or more refrigerants from the recovered refrigerant to obtain the converted refrigerant.

6. The method of claim 1, wherein the refrigeration unit is a refrigeration circuit selected from a residential heating, ventilation, air conditioning (HVAC) system, a commercial heating, ventilation, air conditioning (HVAC) system, an industrial cooling and/or heating system, or a transport refrigeration system.

7. The method of claim 1, wherein the converted refrigerant is one of a R400 series refrigerant blend and a R500 series refrigerant blend.

8. The method of claim 7, wherein the one or more additional refrigerants include R1234yf.

9. The method of claim 7, wherein the one or more refrigerants of the recovered refrigerant include R134a.

* * * * *